United States Patent [19]

Allen et al.

[11] Patent Number: 4,486,995

[45] Date of Patent: Dec. 11, 1984

[54] INSULATING PANEL

[76] Inventors: Robert L. Allen, 841 Panorama, Milford, Mich. 48042; Peter H. Burgher, 3739 Cottontail La., Utica, Mich. 48087

[21] Appl. No.: 365,629

[22] Filed: Apr. 5, 1982

[51] Int. Cl.[3] ..... E04C 1/00

[52] U.S. Cl. ..... 52/309.8; 52/484; 52/DIG. 4; 428/461; 428/507

[58] Field of Search ..... 52/309.9, 309.8, 484, 52/DIG. 4, 311; 428/318.4, 461, 507, 511

[56] References Cited

U.S. PATENT DOCUMENTS

| | | | |
|---|---|---|---|
| 2,730,772 | 1/1956 | Jones | 52/309.9 X |
| 2,841,253 | 7/1958 | Coffman et al. | 183/34 |
| 3,122,216 | 2/1964 | Bultz et al. | 52/484 X |
| 3,832,812 | 11/1974 | Hiatt | 52/127 |
| 3,913,292 | 10/1975 | Brackkan | 52/406 |
| 3,969,868 | 7/1976 | Bainter et al. | 52/309.9 X |
| 4,034,528 | 7/1977 | Sanders et al. | 52/311 X |
| 4,077,168 | 3/1978 | Smith | 52/622 |
| 4,107,892 | 8/1978 | Bellem | 52/403 |
| 4,136,497 | 1/1979 | Porter | 52/593 |
| 4,147,004 | 3/1979 | Day et al. | 52/309 |
| 4,221,697 | 9/1980 | Osborn et al. | 428/220 |
| 4,272,936 | 6/1981 | Bonaguidi | 52/309 |

FOREIGN PATENT DOCUMENTS

| | | | |
|---|---|---|---|
| 860126 | 2/1961 | United Kingdom | 52/DIG. 4 |

*Primary Examiner*—Carl D. Friedman

*Attorney, Agent, or Firm*—Gifford, VanOphem, Sheridan, Sprinkle and Nabozny

[57] ABSTRACT

An insulating panel which comprises at least one layer of polystyrene covered on at least one side by a layer of cellulose. Preferably, the cellulose is intermixed with an adhesive and sprayed onto the polystyrene and the adhesive, and upon curing, bonds the cellulose together and to the polystyrene layer; or, alternatively, the cellulose material is molded into a pad or panel which is subsequently bonded to the polystyrene layer. The exposed side of the cellulose layer is in turn covered with a vinyl or other decorative coating to form the insulating panel. The overall insulating panel exhibits a very high R value and thus has a very low coefficient of thermal conductivity.

6 Claims, 5 Drawing Figures

INSULATING PANEL

BACKGROUND OF THE INVENTION

I. Field of the Invention

The present invention relates to an insulating panel and method for constructing the same.

II. Description of the Prior Art

The proper insulation of building structures, both commercial and residential, has become increasingly important in view of the high cost of energy used in heating such buildings. One common way of building the ceiling of a structure is to use a so-called dropped or suspended ceiling with insulation in the roof above the ceiling or elsewhere in the structure. In a dropped ceiling, a grid having a plurality of rectangular openings is suspended from the building structure. A ceiling tile is then inserted within each opening in the grid to form the suspended ceiling.

These previously known ceiling tiles are typically constructed of a relatively thin layer of fiberglass or mineral fiber having one side covered with a vinyl or other decorative covering. These previously known ceiling tiles, however, are disadvantageous in a number of different respects.

First, these previously known ceiling tiles provide only limited insulation for the ceiling of the building structure. Typically, these ceiling tiles have an R value of 2 or less. As is well known in the trade, an insulating panel having a high R value provides greater insulation than a panel having a lower R value.

A still further disadvantage of these previously known ceiling tiles is the inability of the tile to seal against the grid for the suspended ceiling. An inadequate seal between the ceiling tile and the suspended ceiling grid creates air leaks between the tiles and the work, thus degrading the insulating characteristics of the suspended ceiling.

A still further disadvantage of these previously known ceiling tiles is that such tiles have relatively low structural strength. As such, both the overall surface area size of the ceiling tiles, as well as the thickness of the tiles, is limited which further limits the overall insulating capability of the ceiling tiles.

Another disadvantage of known systems is that to achieve a high insulating factor, layers of insulation are sometimes placed on top of the ceiling tiles after they are in place. This limits access to the space above the tiles.

SUMMARY OF THE PRESENT INVENTION

The present invention provides an insulating panel particularly suited for use as a ceiling tile which overcomes all of the above-mentioned disadvantages of the previously known ceiling tiles.

In brief, the ceiling tile according to the present invention comprises at least one layer of polystyrene approximately one inch in thickness. Preferably, one side of the polystyrene layer is covered with metal foil, and the one inch thick, foil backed polystyrene has an R factor of about 7.6. The tile can be used without metal foil and this has an R factor of about 5.25 to 6.25.

The side of the polystyrene layer without the foil is then covered with a layer of cellulose. Preferably, the cellulose (which can be a fire resistant material) is intermixed with an adhesive, sprayed or otherwise deposited onto the nonfoil side of the polystyrene layer and then compressed against the polystyrene layer to a thickness of preferably between one and three inches. Alternatively, the cellulose material is molded into a pad or panel which is subsequently bonded with an adhesive to the polystyrene layer. The adhesive, upon curing, bonds the cellulose to the polystyrene. Cellulose has an R factor of 3.7/inch to 4.5/inch so that a two inch layer of cellulose has an R factor of about 7.4 to 9.0.

The exposed side of the cellulose layer is then covered with a vinyl or other decorative covering having an R factor which is estimated to be about 1.5. The panel constructed in this fashion can then be covered with additional fire resistant material made from a thixotropic gel, latex-based with a high solids content of silicates, fibers and actual stone products, which has an R factor of about 1.5. The thixotropic gel or other similar material not only renders the insulating panel additionally fire resistant, but also provides a pleasing exterior appearance for panel.

An alternative form of the present invention embodies a dike or raised portion of cellulose material surrounding the edges of the polystryene to provide "drip" resistance and additional fire resistance with respect to the polystyrene layer.

Consequently, the panel or tile constructed according to the present invention has an R factor of approximately 19.6 (assuming a two inch layer of cellulose), which provides much better heat insulation than the previously known ceiling tiles. In addition, the polystyrene layer and cellulose layer have a much higher structural strength than the previously known ceiling tiles so that larger tiles can be effectively used with a suspended ceiling. The use of larger tiles reduces the cost of the suspended ceiling grid as well as the installation costs of the ceiling tiles.

BRIEF DESCRIPTION OF THE DRAWING

A better understanding of the present invention will be had upon reference to the following detailed description when read in conjunction with the accompanying drawing, wherein like reference characters refer to like parts throughtout the several views and in which.

DETAILED DESCRIPTION OF THE PREFERRED EMBODIMENT OF THE INVENTION

Figure 1:
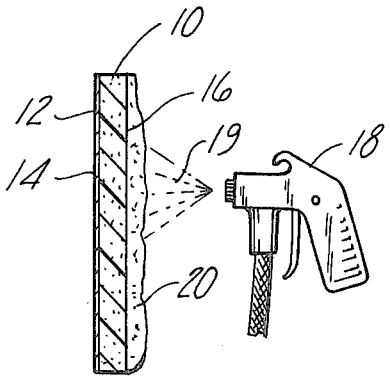
FIG. 1 is a side view illustrating a first step in constructing an insulating panel according to the present invention.

With reference first to FIG. 1, the building panel according to the present invention comprises a layer of polystyrene 10 having one side 12 covered by metallic foil 14. The polystyrene 10 is preferably one inch in thickness and foamed formed. The polystyrene layer 10 together with the metallic foil 14 has an R factor of approximately 7.6.

Still referring to FIG. 1, a mixture of cellulose and a latex based adhesive 19 is sprayed or otherwise deposited onto the other side 16 of the polystyrene layer 10 by any conventional means, such as a spray gun 18. This mixture of cellulose and adhesive forms a cellulose layer 20 on the side 16 of the polystyrene layer 10 and the adhesive, upon curing, bonds the cellulose together and to the polystyrene 10. Alternatively, the cellulose material may be separately molded into a pad or panel which can subsequently be bonded to the polystyrene layer. In either case, the two materials are bonded into one unit.

Figure 2:
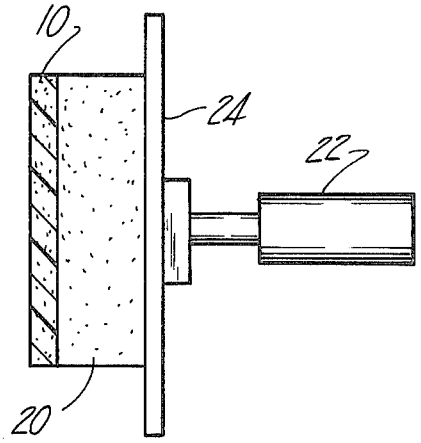
FIG. 2 is a side view similar to FIG. 1, but illustrating a further step in constructing the insulating panel according to the present invention.

With reference now to FIGS. 1 and 2, after a sufficient amount of the cellulose and adhesive mixture 19 is sprayed onto the polystyrene layer 10, the cellulose and adhesive mixture is compressed, as best shown in FIG. 2, against the polystyrene layer 10 to form a cellulose layer 20 between one and three inches in thickness. The cellulose has an R factor of 4.50 per inch so that, for example, a two inch thickness of cellulose provides an additional R factor of 9.0 for the insulating panel. In addition, although a simple ram 22 and plate 24 is illustrated in FIG. 2 as forming the means for compressing the cellulose and adhesive mixture 19 against the polystyrene layer 10, any other conventional means can be employed.

Figure 3A:
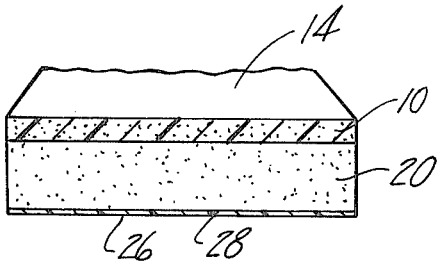
FIG. 3*a* is a cross-sectional view of one form of completed insulating panel according to the present invention and enlarged for clarity.

With reference now to FIG. 3A, after the adhesive in the adhesive and cellulose mixture 19 has cured, a vinyl covering 26 is attached to the exposed side 28 of the cellulose layer 20 by any conventional means, such as an adhesive. The vinyl covering 26 provides both a decorative appearance for the insulating panel and also has an R insulating factor of approximately 1.5. The vinyl covering 26 is available in a wide variety of different colors. It should be obvious that other decorative coatings could be substituted for the vinyl covering 26.

After attaching the vinyl covering 26 to the cellulose layer 20, a fireproof coating is applied to the insulating panel. Preferably, this fireproof coating is made from a thixotropic gel which is latex based with a high solid content of silicates, fibers, and actual stone products. Other similar coatings can be used, however, instead of a thixotropic gel. Such a fireproof coating not only increases the fire resistance of the insulating panel but also provides a highly decorative appearance for the insulating panel. Such a fireproof coating also has an R factor of approximately 1.5.

It should be understood that although the invention as it has been thus far described includes a polystyrene layer 10, it should be understood that other similar plastic foam materials such as polyurethane can be substituted for polystyrene to form the layer 10.

Assuming the insulating panel according to the present invention is constructed with a cellulose layer two inches thick, the overall R factor for the insulating panel is calculated by adding the R value of each layer together in the following fashion:

| Layer | R Factor |
|---|---|
| Foil backed polystyrene layer | 7.6 |
| Two inches cellulose layer | 9.0 |
| Coating | 1.5 |
| Vinyl covering | 1.5 |
| Total R Factor | 19.6 |

Thus, it can be seen that the insulating panel according to the present invention with a two-inch cellulose layer has an estimated overall or total R factor of approximately 19.6.

Figure 4:
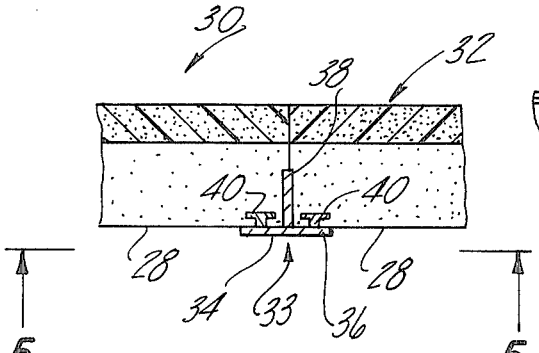
FIG. 4 is a side view illustrating a preferred installation of the building panel according to the present invention in a suspended ceiling grid.
Figure 5:
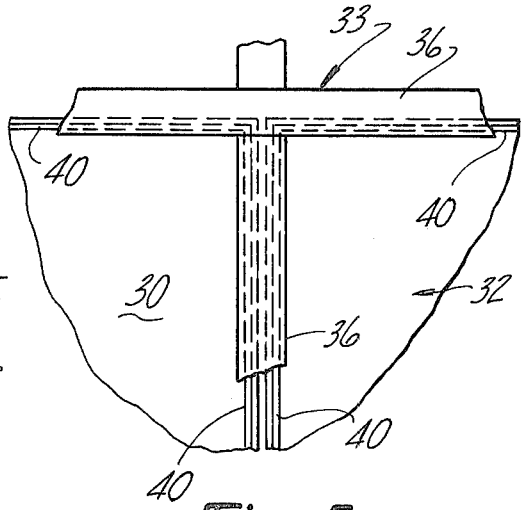
FIG. 5 is a fragmentary view taken substantially along line 5—5 in FIG. 4 and with parts removed for clarity.

With reference now to FIGS. 4 and 5, the installation of two insulating panels 30 and 32 according to the present invention within a conventional suspended ceiling grid 33 is thereshown. The suspended ceiling grid 33 includes a T-rail 34 having a lower horizontally extending support flange 36 and a vertically upwardly extending flange 38 (FIG. 4). The insulating panels 30 and 32 abut against opposite sides of the vertical flange 38 and, upon doing so, the opposite sides of the horizontal flange 36 support the adjacent edges of the insulating panels 30 and 32. Simultaneously, the panels 30 and 32 abut together to minimize or even eliminate air leaks between the insulating panels 30 and 32.

FIGS. 4 and 5 also illustrate a modification of the invention in which an elongated magnetic strip 40 is embedded along each edge of both panels 30 and 32 so that the magnetic strips 40 register with the lower flange 36 of the T-rails 34. The T-rails 34 are conventionally made of steel or other ferro magnetic material so that the magnetic strips 40 seal against the T-rails 34 and minimize or altogether eliminate air leaks between the panels 30 and 32 and the ceiling grid 33.

Figure 3B:
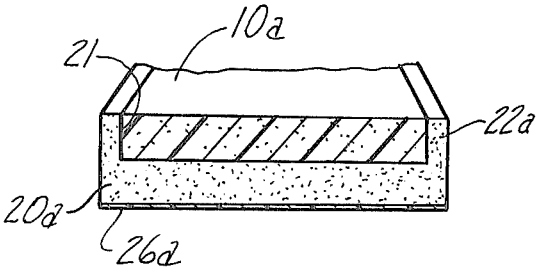
FIG. 3*b* is a cross-sectional view of an alternative form of a completed insulating panel according to the present invention and enlarged for clarity.

FIG. 3B illustrates a modification of the present invention in which the cellulose **20*a* is formed with recess 21 and the plastic foam material 10*a* sets in the recess 21 and is bonded to the cellulose 20*a*. A vinyl covering 26*a* or similar material is affixed to the cellulose 20*a***.

The embodiment of FIG. 3B provides a dike or raised portion **22*a* of cellulose material surrounding the edges of the polystyrene material 10*a*. In addition to providing increased fire resistance, the raised portion 22*a* also prevents the polystyrene material 10*a*** from flowing over the edge of the panel when subjected to the heat produced by a fire.

From the foregoing, it can be seen that the present invention provides a unique insulating panel which is particularly suitable for use as a ceiling tile for a suspended ceiling. The insulating panel according to the present invention enjoys high structural strength (a) because of its thickness and (b) because of the unique combination of materials which enables relatively large ceiling panels to be used with the suspended ceiling.

The insulating panel of the present invention is further advantageous in that it is constructed of nontoxic, nonirritating and noncorrosive material. Furthermore, the use of cellulose as an insulating material enables the efficient use of recycled wood and paper products. Cellulose also permits the use of polystyrene in the ceiling in a fashion which overcomes the danger of fire.

It should be apparent that although the panel of the present invention has been described for use as a ceiling tile with suitable modifications it could be used as a side wall panel as well. Also, although the insulating characteristics of the panel has been emphasized, its sound insulating characteristics and its fire resistance are also important.

Having described our invention, many modifications thereto will become apparent to those skilled in the art to which it pertains without deviation from the spirit of the invention as defined by the scope of the appended claims.

We claim:

1. An insulating panel comprising:

a layer of plastic foam material;

a layer of cellulose and adhesive mixture wherein a first side of said cellulose and adhesive layer is formed with a dike or raised portion and wherein said plastic foam layer is bonded to said first side of said cellulose and adhesive layer within said raised portion;

a decorative layer; and means for securing said decorative layer to a second side of said cellulose and adhesive layer.

2. The invention as defined in claim 1 and further comprising a metal foil covering a second side of said plastic foam.

3. The invention as defined in claim 1 and further comprising a coating of fire resistant material covering substantially the entire exposed surface of the decorative layer.

4. The invention as defined in claim 3 wherein said fire resistant material is made from a latex-based thixotropic gel.

5. The invention as defined in claim 1 wherein said panel is inserted within and supported by a grid of a suspended ceiling, said panel further comprising means for sealing said panel to said grid.

6. The invention as defined in claim 5 wherein said sealing means comprises means imbedded within said panel for magnetically sealing said panel to said grid.

* * * * *